United States Patent [19]

Brosius

[11] 4,252,259

[45] Feb. 24, 1981

[54] HAMMER DRIVE TOOL

[75] Inventor: Ralph Brosius, Creve Coeur, Mo.

[73] Assignee: Brosius Bros., Inc., St. Louis, Mo.

[21] Appl. No.: 43,005

[22] Filed: May 29, 1979

[51] Int. Cl.[3] ..... B25C 1/14; B25C 1/18

[52] U.S. Cl. ..... 227/8; 227/10

[58] Field of Search ..... 227/10, 11, 8, 9

[56] References Cited

U.S. PATENT DOCUMENTS

| | | | |
|---|---|---|---|
| 3,558,032 | 1/1971 | Oefinger | 227/8 |
| 3,620,433 | 11/1971 | Lawton | 227/10 |
| 4,025,029 | 5/1977 | Kotas et al. | 227/10 |

*Primary Examiner*—Paul A. Bell

*Attorney, Agent, or Firm*—Richard G. Heywood

[57] ABSTRACT

A hammer drive, powder actuated tool having a main barrel housing, fastener drive and guide means telescopically slidable in one end of the housing and having a muzzle end for orienting a fastener and a breech end for orienting a fastener-driving powder charge, the other end of said main housing having first anvil means thereon, second anvil means including firing pin means, spring means of substantial force biasing said first and second anvil means apart, and movable safety means disposed between the breech end of said fastener drive and guide means and said firing pin means preventing unrestricted axial movement therebetween and contact between said firing pin and powder charge.

14 Claims, 5 Drawing Figures

HAMMER DRIVE TOOL

BACKGROUND OF THE INVENTION

The invention relates generally to fastener drive tools, and more particularly to anvil-type or hammer drive, powder actuated tools.

Many types of fastener drive tools and like explosively actuated equipment have been developed over the years, and such tools have generally had complex mechanisms for firing pin operation, for ejecting or extracting spent cartridge shells and for meeting safety standards. Recent developmental trends are toward improved low velocity tools of the type in which a piston ram member is explosively driven to actuate a nail or like fastener into a workpiece such as concrete or wood. One type of low velocity tool is described in U.S. Pat. No. 3,066,302, which tool uses a pistol-type firing pin mechanism having a trigger and sear to trip a spring-loaded firing pin that is cocked by compressing the muzzle end of the tool telescopically rearwardly within the tool housing. Many such pistol-type low velocity tools are disclosed in the prior art.

Another type of low velocity tool is described in U.S. Pat. No. 4,025,029, which tool, like the present invention, is a hammer-activated, powder actuated stud driver. Such hammer drive tools are conventionally operated by placing the muzzle end of the tool against the workpiece and striking the rear end of the tool with a hammer to fire the cartridge or like powder charge. Hammer drive tools heretofore, while simple in construction and operation, have been inherently dangerous due to the fact that a loaded tool could be fired if accidentally dropped. U.S. Pat. No. 3,688,964 discloses another low velocity hammer drive tool designed for caseless powder loads and having some safety features.

SUMMARY OF THE INVENTION

The present invention comprises a low velocity, powder actuated tool of the type utilized in construction and other trades, and particularly adapted for use in the home, shop or the like by semi-skilled persons.

The principal object of the present invention is to provide a novel fastener drive tool of the hammer drive or impact type; one that is of simple, rugged construction and eliminates the complex and expensive forms of closure, trigger, sear, firing pin, cartridge holding and ejection and like mechanisms of prevalent tool design.

Another object is to provide a powder actuated tool that is highly efficient in operation and provides exceptional safety standards against drop-fire and other accidental tool discharge incidents. A more specific objective is to provide triple safety means requiring positive manual operation as well as substantial striking force to accomplish firing actuation of the tool.

Still another object is to provide a hammer drive tool that meets the three safety requirements of the American National Safety Code.

These and still other objects and advantages will become more apparent hereinafter.

BRIEF DESCRIPTION OF THE DRAWINGS

For purposes of illustration and disclosure, the invention is embodied in the parts and in the arrangements and combinations of parts hereinafter described and claimed.

In the accompanying drawings which form part of the specification and wherein like numerals refer to like parts wherever they occur.

DESCRIPTION OF THE PREFERRED EMBODIMENTS

Figures 1, 2, 3, 4, 5:
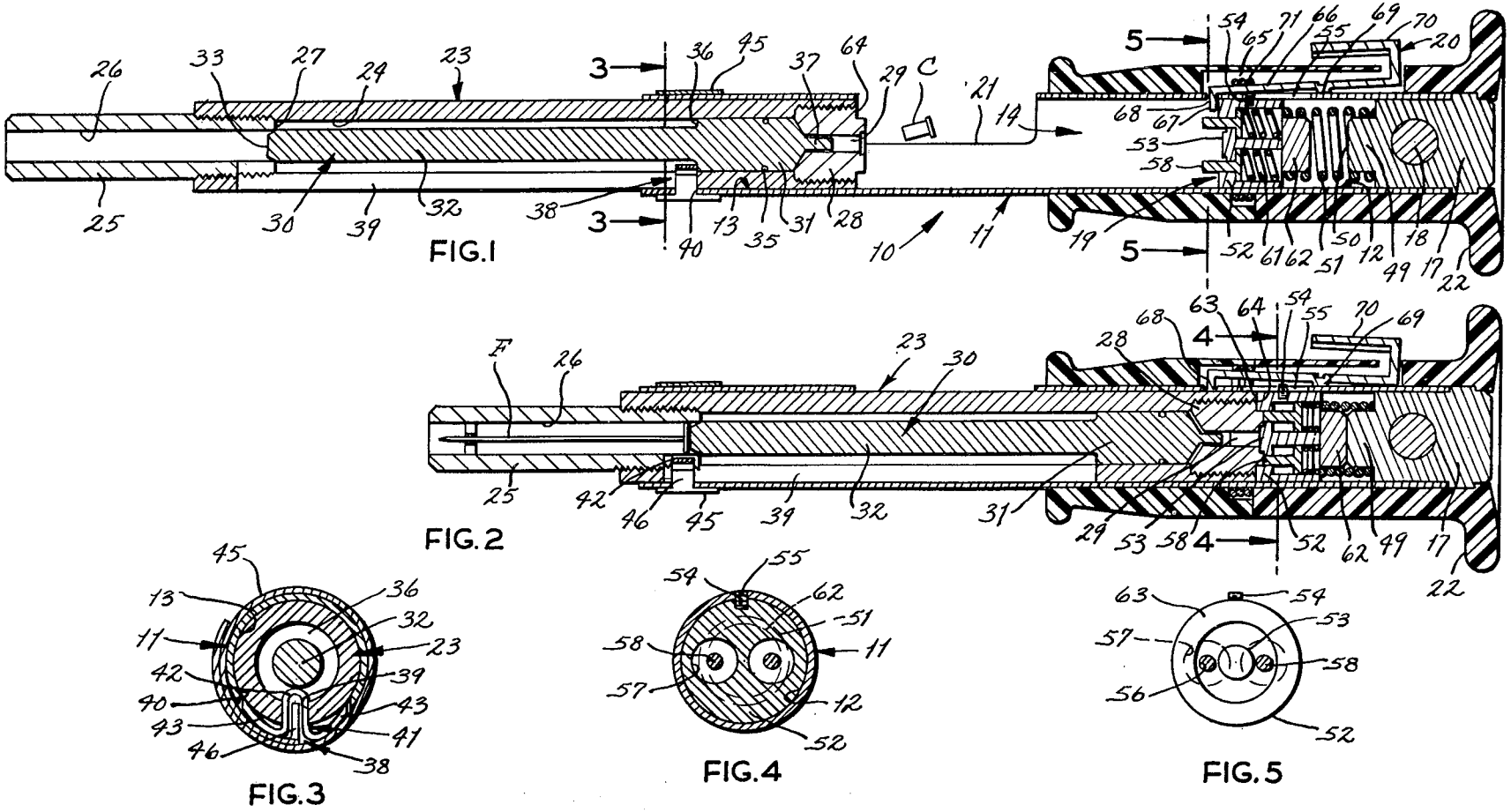
FIG. 1 is a longitudinal cross-sectional view of a hammer drive, powder actuated tool in the expanded or loading position thereof.
FIG. 2 is a longitudinal cross-sectional view of the tool in its compressed condition at the instant of powder detonation.
FIG. 3 is an enlarged fragmentary cross-sectional view taken substantially along line 3—3 of FIG. 1.
FIG. 4 is an enlarged fragmentary cross-sectional view taken substantially along line 4—4 of FIG. 2, but being rotated 90° for correct depiction.
FIG. 5 is an enlarged fragmentary cross-sectional view taken substantially along line 5—5 of FIG. 1, but being rotated 90° for correct depiction.

Referring to the drawings wherein the hammer drive, powder actuated tool 10 is illustrated as a presently preferred embodiment of the present invention, the tool 10 comprises a main cylindrical housing member 11 having a rear firing pin bore section 12 and a front barrel bore section 13 with an intermediate breech or loading area 14. A primary solid anvil member 17 is rigidly secured in the firing pin bore 12 of the main housing 11 by a cross pin 18, and a "floating" firing pin assembly 19 is housed in the firing pin section 12 between the primary anvil mass 17 and the breech or loading area 14, as will be defined more fully hereinafter. A safety lever assembly 20 is pivotally mounted on the main housing 11 intermediate to the firing pin section 12 and breech area 14, and one of its purposes is to limit or restrict free floating forward movement of the firing pin assembly 19 toward the breech section 13. The main housing 11 has a lateral breech opening 21 for access to the inner breech or loading area 14 for purposes of cartridge ejection and reloading of the tool 10. The main housing 11 is provided with a two-piece outer resilient hand grip or housing covering 22 which circumscribes the rear firing pin section 12 and is associated with the safety lever assembly 20, as will be described.

A barrel ram guide member 23 is slidably mounted in the front barrel section 13 of the main housing 11, the guide member having a bore 24 in which a barrel extension 25 is threadedly engaged at the muzzle end. The barrel extension 25 has a bore 26 concentric with the ram guide bore 24 and an annular shoulder 27 is formed between the bores 24 and 26. The ram guide 23 also has a breech plug 28 threadedly engaging the breech end of the bore 24, the breech plug 28 having an ignition cavity 29 for receiving a powder cartridge C (see FIG. 1) or like powder charge. A ram or piston member 30 has an enlarged head 31 with a close tolerance sliding fit in the ram guide bore 24, and an axially extending cylindrical ram or piston rod 32 is slidably positioned in the barrel extension bore 26 with a free or working end therein for engagement with a fastener F. The ram head member 31 has an annular steel or like O-ring seal 35, and an annular abutment shoulder 36 on the head member 31 defines the end of the recess between the piston rod 32 and the ram guide bore 24. The ram and ram guide members 30 and 23 comprise fastener drive means for orienting the fastener member F in the tool 10 and for driving such fastener F into a workpiece (not shown) in a conventional manner readily apparent to those skilled in the art. The ram head 31 is also provided with an axially extending ejection pin 37 for dislodging spent cartridge shells C from the ignition cavity 29.

An important feature of the tool 10 comprises frictional abutment means 38 adjacent to the muzzle end of the main barrel housing 11. The ram guide member 23 has a longitudinal slot 39 extending a major portion of the guide member length, and an arcuate transverse slot 40 is formed in the main housing wall 11 to thereby accommodate a spring clip 41 forming part of the frictional abutment means 38, see FIGS. 1 and 3. The spring clip 41 has a U-shaped central body 42 extending radially inwardly through the ram guide slot 39 into the recess for abutment by the ram head shoulder 36, and arcuate friction wings 43 are formed as outward reentrant curves from the opposed walls of this central body 42, FIG. 3. The frictional abutment means 38 also includes a spring steel retainer band 45 having an inner end flange 46 received between the spaced walls of the spring clip central body 42 to maintain the band 45 in circumscribing relationship around the muzzle end of the main housing 11.

Referring to FIG. 2, the tool 10 is shown in its fully compressed firing position with the ram 30 and ram guide 23 being retracted in telescopic relation within the main housing 11 and the firing pin assembly being compressed in the condition of the tool 10 at the precise instant that a hammer driven force is applied to the primary anvil member 17 to detonate the powder charge C in the breech plug 29. It will be understood by those skilled in the art that the force exerted upon the ram head 31 drives the ram 30 axially in the ram guide 23 and barrel extension 25 so that the working end 33 drives the fastener F from the muzzle end of the barrel extension 25 into the workpiece (not shown). Thus, when the tool has been fired, the ram 30 will naturally be positioned in the ram guide 23 leftwardly of the position shown in FIGS. 1 and 2 until the piston guide is also moved leftwardly (as in FIG. 1) to its expanded, re-loading position. This action is carried out by snapping the muzzle end of the tool outwardly in a swinging movement to throw the ram guide outwardly in the main housing bore 13 against the frictional force exerted therebetween by the spring clip wings 43 of the spring clip 41. In this movement the ram guide 23 moves to its fully extended loading position with the frictional abutment means 38 engaging the end of slot 39, and the ram 30 is also engaged with its abutment shoulder 36 against the U-shaped central body 42 of the spring clip. Thus, in the FIG. 1 position of the tool 10, the ejection pin 37 projects into the cartridge or ignition cavity 29 of the breech plug 28 to eject the spent cartridge shell, which is dropped through the breech opening 21 by inverting the tool 10 from its FIG. 1 position. It will be readily apparent that the frictional abutment means 38 return the ram and ram guide members 30 and 23 to their loading relationship for inserting a new fastener F in the muzzle end of the barrel extension 25 and a cartridge C in the ignition cavity 29 of the breech plug 28. The frictional abutment means 38 also prevents relative rotation of the ram guide member 23 in the main housing 11, and the spring clip 41 and retainer band 45 act frictionally between the ram guide member 23 and main housing 11 to maintain the ram guide frictionally in any adjusted axial position. The steel friction spring 35 between the ram head 31 and ram guide bore 24 maintains the adjusted axial position of the ram 30 in the ram guide member 23.

Referring particularly to FIGS. 1, 4 and 5, the firing pin mechanism of the tool 10 includes the primary anvil member 17 having a centrally projecting impact or anvil block 49 with striking face 50, and a strong drop-spring 51 is positioned on the anvil block 49 and extends concentrically forwardly in the firing pin bore 12 to oppose movement of the ram guide 23 and its cartridge carrying breech plug 28 toward firing position. The spring 51 has a substantial force of approximately 25 to 30 ft. lbs., which is several times the weight of the tool and thereby forms a first safety mechanism to substantially obviate drop-fire incidents. The "floating" firing pin assembly 19 includes a secondary anvil mass or plug 52 slidably positioned in the firing pin bore section 12 of the main housing 11, and a circular firing pin 53 is integrally formed on its forward face in the breech area 14 and is axially aligned with the ignition chamber 29 of the ram guide member 23. The secondary anvil and firing pin member 52,53 is biased forwardly toward the breech area 14 by the strong or "heavy" drop-spring 51, but a stop key or pin 54 projects radially from the secondary anvil member 52 and is guided in a longitudinal slot 55 in the main housing wall 12 to limit forward movement of the firing pin assembly 19 toward the breech area 14.

The firing pin assembly 19 also includes secondary safety means associated with the secondary anvil 52. The anvil 52 is bored through, at 56, on opposite sides of the firing pin 53 and is counterbored from the back, at 57, and receives a pair of diametrally disposed headed studs or safety rivets 58. The rivets 58 are biased by firing pin safety springs 61 positioned in the counterbore 57 and retained therein by a tempered closure anvil block or plate 62, which is welded to the back surface of the anvil plug 52 and serves to retain the forward end of the drop-spring 51. The secondary anvil member 52 also has a forwardly projecting annular shoulder 63 at its periphery, which is adapted to interfit with an annular peripheral recess 64 in the breech plug 28 thereby forming a sealing arrangement at the point of firing contact of the firing pin 53 with a cartridge C. It may be noted that the firing pin 53 has a complete centerfire fit with the percussion flange of the cartridge C, and firing indentation of the cartridge C by penetration of the firing pin is controlled by the sealing arrangement. The safety stud springs 61 are also of substantial force or "heavy," each being about the same magnitude as the drop-spring 51 (approximately 28 ft. lbs.) whereby the combined spring forces to be overcome to fire the tool 10 substantially eliminate accidental firing incidents.

The safety lever assembly 20 comprises the third safety device of the present tool 10, and comprises an elongated lever body 66 longitudinally disposed along the firing pin section 12 of the housing 11 and contained within the davity section 65 formed in the resilient covering 22 therefor. A safety latch or lug 67 is formed substantially at right angles on the forward end of the lever body 66 and extends radially inwardly of the cylindrical main housing 11 through a transverse slot 68 and defines the forwardmost limit of the firing pin assembly 19 as a secondary stop to the limit plug 54. More importantly, the latch 67 acts to prevent accidental rearward movement of the ram guide member 23 as will be described. The other end of the lever body 66 is provided with a handle 70 extending outwardly of the resilient covering 22, and the lever body 66 is hinged or pivoted on the main housing 11 on a fulcrum mounting lug 69 intermediate to the latch 67 and the outwardly extending handle portion 70. A wrap-around spring 71 or the like compresses the latch member 67 inwardly to form the safety abutment in the main housing bore, and the spring 71 is overcome by depressing the handle 70 radially inwardly against the hand grip covering 22. It will be apparent that the handle-fulcrum-latch relationship can be modified to provide optimum safety lever action.

In the extended, loading position of the tool 10 as shown in FIG. 1, a new cartridge C is inserted into the ignition cavity 29 thereby pressing against the ejection plug 37 and axially moving the entire ram 30 slightly to the left, where the ram 30 is held in position with the ram guide 23 by the friction sealing spring 35. A fastener F is inserted in the muzzle end of barrel extension bore 26 against the ram work face 33, and the fastener drive and guide means 30,23 is moved rearwardly toward the firing pin section 13 to close the breech opening 21 and position the breech plug 28 of the ram guide 23 against the ends of the safety guide rivets or studs 58, which project axially beyond the safety lever latch 68, FIG. 1. Although the safety lever mechanism 20 forms the only positive interference safety device, that prevents unrestricted axial movement of the guide means 23 and firing pin assembly 19 into contacting or firing abutment, the combined force of the two firing pin safety springs is approximately 56 ft. lbs. and effectively prevents compressive firing action by the operator or other inadvertent compressive forces of great magnitude, such as accidental drop-fire incidents. Therefore, it will be seen that in the normal sequence of compression, the drop-spring 51 would first become compressed to bring the ram guide 23 into abutment with the safety latch 68 before the firing pin safety springs 61 will give way to striking engagement between the firing pin 53 and cartridge C in the breech plug 28.

In actual operation, when the tool 10 is positioned against a workpiece (not shown) and ready for firing, the ram and ram guide 30,23 will be telescoped into the barrel housing with the breech plug 28 abutting the ends of the safety rivets 58. The safety lever handle 70 is then depressed to pivot the latch 68 out of the barrel bore 14 against the action of spring 71, and the primary anvil 17 is struck solidly by a heavy hammer (not shown) weighing about one pound or greater. It is again emphasized that the hammer force must overcome the 25 to 30 ft. lbs. force of the spring 51 to drive the primary and secondary anvil members 17 and 52,62 together and also overcome the combined forces of firing pin safety springs 61 to provide firing contact of the firing pin 53 against the cartridge C, as shown in FIG. 2.

It will thus be readily apparent that the two firing pin safety studs 58 and springs 61, as positioned immediately adjacent to the firing pin 53 and acting in opposition to relative firing actuation, assure the deliberate and safe operation of the tool 10 and assure against substantially all inadvertent tool mishaps. From the foregoing description it will be readily apparent that the present fastener drive tool 10 meets the various objectives of simplicity, safety and efficiency in construction, handling and operation. The essential simplification of the invention pertains to the "floating" secondary anvil 52 that is spring loaded by a "heavy" spring 51 away from the primary anvil mass 17, and in the provision of a positive safety latch 20 that is manually retractable to condition the tool for firing. It may be noted that the handle 70 of the safety lever 20 is positioned radially inwardly of the large end flange of the resilient hand grip 22 so that it is also protected against release do to accidental dropping incidents. Various changes and modifications of the tool 10 will be apparent to those skilled in the art without departing from the inventive concept. Accordingly, the invention is limited only by the scope of the claims which follow.

What is claimed is:

1. A hammer drive, powder actuated tool having a main housing, relatively movable fastener drive and guide means telescopically slidable in one end of the housing and having a muzzle end for orienting a fastener and a breech end for orienting a fastener-driving powder charge, first anvil means secured to the other end of said main housing, second anvil means movably positioned in said main housing adjacent to said first anvil means and including firing pin means, spring means of substantial force biasing said first and second anvil means axially apart, said fastener drive and guide means being axially movable toward said firing pin means preparatory to firing engagement of said firing pin means with said powder charge, and movable safety means disposed between the breech end of said fastener drive and guide means and said firing pin means for restricting relative axial movement therebetween and contact between said firing pin means and powder charge.

2. The hammer drive tool according to claim 1, in which said movable safety means comprises releasable safety latch means radially disposed in said main housing between said firing pin means and said fastener drive and guide means.

3. The hammer drive tool according to claim 1, in which said movable safety means comprises spring loaded stud means yieldably disposed between said second anvil means and said fastener drive and guide means.

4. The hammer drive tool according to claim 3, in which said spring loaded stud means projects axially from said second anvil means immediately adjacent to said firing pin means.

5. The hammer drive tool according to claim 4, in which a pair of spring loaded stud means are disposed diametrally of said firing pin means.

6. The hammer drive tool according to claim 5, in which said spring loaded safety studs are biased by compression safety springs of substantial force, and the substantial forces of said safety springs and said first mentioned spring means are additive in opposing relative movement of said firing pin means and powder charge into firing contact.

7. The hammer drive tool according to claim 1, in which said movable safety means comprises safety stud means projecting axially from said second anvil means beyond said firing pin means, and safety spring means responsive only to substantial compressive forces for permitting yieldable retracting movement of said safety stud means in internally telescoping relationship with said second anvil means.

8. The hammer drive tool according to claim 1, in which said spring means forms primary safety means yieldably opposing striking abutment of said first and second anvil means preparatory to firing engagement of said firing pin means with said powder charge.

9. The hammer drive tool according to claim 8, wherein said movable safety means comprises spring loaded stud means projecting from said second anvil means beyond said firing pin means and forms secondary safety means yieldably opposing firing engagement of said firing pin means with said powder charge.

10. The hammer drive tool according to claim 9, wherein said movable safety means also comprises releasable safety latch means normally positioned in the housing between said second anvil means and said fastener drive and guide means and forms third safety means positively preventing unrestricted axial movement of fastener guide and drive means into firing engagement with said firing pin means.

11. The hammer drive tool according to claim 1, in which said fastener drive and guide means comprise a ram and a ram guide member for guiding axial ram movement from a substantially fully telescoped firing position to an extended fastener driving position in said ram guide member, and spring clip and retainer means disposed between said housing member, ram guide member and ram for returning said ram to its firing position, said spring clip and retainer means being disposed adjacent to said one end of said main housing and including a spring clip member having a first portion radially extending in a longitudinal slot in said ram guide member to provide rectilinear sliding movement thereof and a second portion frictionally engaged between said main housing and said ram guide member to maintain any axially adjusted position therebetween.

12. The hammer drive tool according to claim 11, in which said spring clip and retainer means comprises a spring clip member having a U-shaped central body portion to be slidably received in said longitudinal slot of said ram guide member, and a pair of arcuate reentrant wing portions extending from said central body portion for frictional contact with the ram guide member on each side of said longitudinal slot.

13. The hammer drive tool according to claim 12, in which said spring clip and retainer means also comprises a spring retainer band circumscribing the main housing and having an inner end flange extending radially into the U-shaped body, said retainer band compressing said wing portions against said ram guide member.

14. In a hammer drive, powder actuated tool having a main housing with a muzzle end and an impact end, fastener guide means having a muzzle end for orienting a fastener and a breech end for orienting a fastener-driving powder charge and being axially slidable in said housing between extended breech loading and retracted ready-to-fire positions, the impact end of said main housing having a primary anvil member secured thereto; the improvement comprising floating firing pin means disposed between said primary anvil member and said breech end of said fastener guide means, said floating firing pin means comprising a secondary anvil member adjacent to the primary anvil member and spring means biasing said anvil members apart, a firing pin on said secondary anvil and being axially aligned with the powder charge on the breech end of said fastener guide means, said primary anvil member and said main housing being driven relative to said fastener guide means in response to a substantial striking force on said primary anvil member to thereby move said primary and secondary anvil members against the biasing action of said spring means and said firing pin into firing contact with the powder charge.

* * * * *